US006938794B2

(12) United States Patent
Elder

(10) Patent No.: US 6,938,794 B2
(45) Date of Patent: Sep. 6, 2005

(54) LIP ACTUATED VALVE CLOSURE FOR A DRINKING BOTTLE

(75) Inventor: Jack E. Elder, Rochester, MI (US)

(73) Assignee: Innatech, LLC, Rochester, MI (US)

( * ) Notice: Subject to any disclaimer, the term of this patent is extended or adjusted under 35 U.S.C. 154(b) by 123 days.

(21) Appl. No.: 10/132,087

(22) Filed: Apr. 25, 2002

(65) Prior Publication Data

US 2002/0179616 A1 Dec. 5, 2002

Related U.S. Application Data

(60) Provisional application No. 60/287,520, filed on Apr. 26, 2001.

(51) Int. Cl.[7] ..... A47G 19/22

(52) U.S. Cl. ..... 220/714; 220/717; 220/303; 220/254.9; 215/387; 222/525; 222/514

(58) Field of Search ..... 215/11.4, 11.5, 215/387, 322; 220/717, 254.5, 281, 292, 326, 710, 714, 716, 203.01, 203.11, 203.17, 203.25, 209.23, 303, 254.9, 264; 222/511, 513, 514, 522, 525

(56) References Cited

U.S. PATENT DOCUMENTS

| | | | | |
|---|---|---|---|---|
| 2,628,004 A | | 2/1953 | Schicksupp | |
| 3,321,114 A | * | 5/1967 | Croyle | 222/499 |
| 3,360,161 A | * | 12/1967 | Smith | 220/719 |
| 3,727,808 A | * | 4/1973 | Fitzgerald | 222/482 |
| 3,915,331 A | * | 10/1975 | Chenault | 220/711 |
| 4,141,474 A | * | 2/1979 | Nilson | 222/493 |
| 4,184,603 A | * | 1/1980 | Hamilton, Sr. | 220/254.9 |
| 4,238,045 A | | 12/1980 | D'Andria | |
| 4,506,809 A | | 3/1985 | Corsette | |
| 5,265,777 A | | 11/1993 | Weinstein | |
| 5,292,035 A | | 3/1994 | Millar | |
| 6,202,877 B1 | * | 3/2001 | La Torre et al. | 220/254.1 |
| 6,202,901 B1 | * | 3/2001 | Gerber et al. | 222/494 |
| 6,213,351 B1 | | 4/2001 | Stoneberg et al. | |
| 6,298,554 B1 | | 10/2001 | Fuchs | |
| 6,299,027 B1 | * | 10/2001 | Berge et al. | 222/153.14 |
| 6,309,059 B1 | * | 10/2001 | Ritter | 347/86 |
| 6,341,721 B1 | | 1/2002 | Herald et al. | |
| 6,547,108 B2 | * | 4/2003 | Johanson | 222/387 |
| 6,568,566 B2 | * | 5/2003 | Smith | 222/153.06 |
| 6,616,012 B2 | * | 9/2003 | Dark | 222/1 |

FOREIGN PATENT DOCUMENTS

WO WO 176965 A1 * 10/2001 ..... B65D/47/20

* cited by examiner

*Primary Examiner*—Lee Young
*Assistant Examiner*—James Smalley
(74) *Attorney, Agent, or Firm*—Maginot, Moore & Beck

(57) ABSTRACT

A closure for a liquid container, such as a sports drink bottle, includes a base component that is engaged over the mouth of the container, and a cap component engaged on the base component for movement from a closed position to an open position by pressure from the lips of the consumer. The base component includes a valve element supported on a fenestrated pedestal. The cap component includes a body defining a drinking surface for contacting the lips of the consumer and an annular sealing disc recessed below the drinking surface. The sealing disc is retained by the valve element against the force of a resiliently deformable seal disposed between the base component and the cap component. The seal has a sealing rim that is in constant contact with the base portion and provides an upward spring force to hold the sealing disc in the normally closed position. The seal includes a flexible hinge that allows the resiliently deformable seal to bow outward or bellows when the cap is depressed.

18 Claims, 5 Drawing Sheets

LIP ACTUATED VALVE CLOSURE FOR A DRINKING BOTTLE

REFERENCE TO RELATED APPLICATION

This utility patent application claims priority to co-pending provisional application, Ser. No. 60/287,520, entitled "Fluid Conduits and Valves and Method of Manufacturing Same", filed on Apr. 26, 2001, the disclosure and figures of which is incorporated herein by reference.

BACKGROUND OF THE INVENTION

The present invention relates to closures for fluid containers, such as sports water bottles. More particularly, the invention concerns a valve closure that is self-sealing but readily opened by the consumer.

Valves are currently manufactured in many configurations depending upon the particular use for the valve. For instance, many fluid handling applications utilize compression valves, sleeve cartridges, disk cartridges and ball valves. Many of these valves rely upon a compressible washer to seal the valve when not in use.

So-called dispensing closures incorporate a valve within a closure for a fluid container. Dispensing closures have found widespread use on containers for consumer beverages and sport drinks. One common beverage closure includes a valve element that is pulled outward to open the valve. This type of closure requires the user to actively close the valve by pushing it back into the container closure.

Some fluid container closures include an automatically closing valve, or a valve that is biased to a closed position. Self-sealing closures of this type are not generally used with beverage containers because of the general complexity of the valve structure. In a typical self-closing or self-sealing valve, a spring or lever arrangement is integrated between the valve and the closure. While this relatively involved structure is highly acceptable for reusable closures, it is usually too costly for application as a closure to a disposable drinking bottle, for instance. Moreover, the working components are susceptible to breakage if the bottle is dropped, rendering the valve useless.

Consequently, there remains a need for a self-sealing, readily openable valve closure that is well suited for use on a consumer beverage bottle. This need encompasses a valve closure that is as applicable to a disposable beverage container as it is to a reusable sports bottle. This optimum valve closure would have no mechanical moving parts, would be easy to manufacture and virtually failure-proof.

SUMMARY OF THE INVENTION

The present invention contemplates a valve closure that meets all of these needs and more. In a preferred embodiment, the invention provides a valve closure formed of two components movable relative to each other. More specifically, the closure includes a base that is configured to engage the mouth of the beverage container, and a cap that is movably mounted on the base. Both components are constructed in a manner that is susceptible to formation in an injection molding process and particularly a plastic molding process.

In one aspect of the invention, the base component includes a skirt that is sized to be mounted over the mouth of a typical consumer beverage bottle or sports water bottle. Most preferably, the skirt includes internal threads to be threaded over the bottle mouth, although other generally permanent engagements are contemplated. The base component includes a closure portion covering the mouth of the container. The closure portion includes a concentrically disposed upstanding valve element, which is preferably in the form of a circular disc with an undercut at its bottom surface. The valve element is supported at the top of a fenestrated pedestal, the pedestal providing openings for the passage of liquid from the container or bottle past the valve element.

In another feature of the invention, the cap component is pressed onto the base component over the closure portion, and more specifically over the valve element. The cap component can be formed as a single piece, but is preferably formed of two sub-components, namely a body and an elastomeric, resiliently deformable, or flexible seal. The body includes a sealing skirt that presents a sliding seal against a portion of the base component to provide secondary protection against leakage from the valve closure. An upper portion of the body defines a drinking opening through which the liquid passes. The drinking opening is surrounded by a pressure surface which is sized and configured to provide a surface against which the consumer can press his/her lips to open the valve. Specifically, the valve can be opened by applying lip pressure against the pressure surface to displace the cap axially relative to the base component and its valve element.

The second sub-component of the cap, the flexible seal, is a generally cylindrical elastomeric member that includes a sealing disc that bears against the undercut portion of the valve element to provide a fluid-tight seal. In certain embodiments, the sealing disc can include a sealing rim that defines an annular opening through the disc. The sealing rim helps provide an affirmative fluid seal when the valve is in its normally biased closed position.

This biased closed position is accomplished by a downwardly extending cylindrical element composed of an upper portion and a lower portion separated by a flexible hinge. The sealing disc is integral with the upper portion, while the flexible hinge is integral with the upper and lower portions. Most preferably, the cylindrical element is molded as a single piece, with the flexible hinge constituting a ring of reduced thickness around the cylindrical element. This ring of reduced thickness allows the lower portion to bend at an angle relative to the upper portion. In addition, in a most preferred embodiment, the upper and lower portions are themselves flexible so that the portions can bend or bow when the cap is depressed.

The lower portion includes an annular lower sealing rim that bears against an intermediate plate formed in the base component. In the normally closed position, the elastomeric or resiliently deformable seal is trapped between the valve element and the intermediate plate so that the cylindrical element of the seal provides a fluid-tight chamber around the fenestrated pedestal. The cylindrical element is slightly conical to maintain a tight seal in the biased closed position. The elastomeric or resilient properties of the cylindrical element force the lower sealing and upper sealing rims apart against their respective sealing seats.

When the valve closure is to be opened, the user applies pressure to the cap by bearing his/her lips against the drinking surface of the cap body. As the cap is pushed toward the mouth of the beverage container, the elastomeric seal undergoes a controlled deformation, primarily at the flexible hinge. As the pressure is applied, the cylindrical element of the elastomeric seal bows outwardly at the flexible hinge. In addition, the upper and lower portions of the cylindrical element can bend or curve slightly. With this motion, the upper sealing bead and sealing disc are moved away from the uppercut of the valve element, exposing the openings in the fenestrated pedestal to the central opening of the cap. At the same time, the pressure that bows the cylindrical element of the elastomeric seal also forces the lower sealing rim against the intermediate plate to maintain a fluid-tight seal.

When the consumer is done drinking, he/she simply releases the lip pressure against the cap. The elastomeric seal then springs back to its original biased shape, forcing the sealing disc upward against the undercut of the valve element. In a most preferred embodiment, the elastomeric seal is formed of a rubber that has good fluid sealing properties, combined with sufficient elastic properties to maintain solid pressure between the various sealing surfaces. However, the material of the elastomeric seal is not too stiff to make depression of the cap by a consumer's lips difficult.

In one aspect of the preferred embodiment, the intermediate plate defines a retention bead that controls the radially outward displacement of the lower sealing bead of the elastomeric seal. Thus, the retention bead prevents the lower portion of the cylindrical element from splaying outward when the cap is depressed, which might compromise the sealing capacity for the lower sealing bead.

In a further feature of the invention, the elastomeric seal and cap body components can be integrated or molded together. Thus, the elastomeric seal can include a series of fingers projecting upward from the sealing disc. The cap body can define a series of slots at the drinking opening that are arranged to interlock with the fingers of the seal. Most preferably, the two components can be molded together with one component being over-molded about the other component.

It is one object of the invention to provide a valve closure that is inexpensive and simple to produce. A further object is accomplished by features that make the valve closure well suited for use on a disposable beverage bottle. Other objects and certain benefits of the invention will become apparent from the following written description and accompanying figures.

DESCRIPTION OF THE PREFERRED EMBODIMENT

Figure 1:
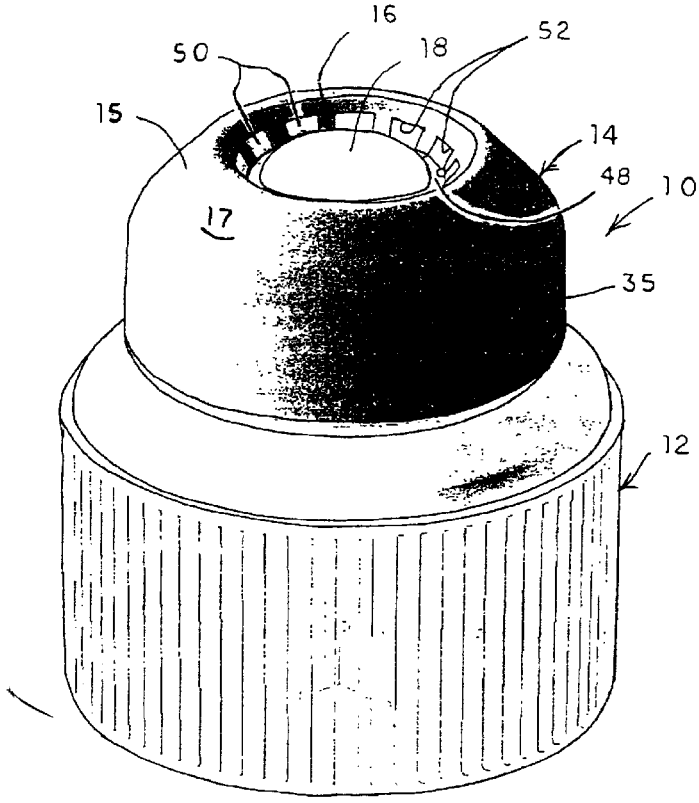
FIG. 1 is a top perspective view of a valve closure in accordance with a preferred embodiment of the present invention, depicted with the valve in its normally closed position.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
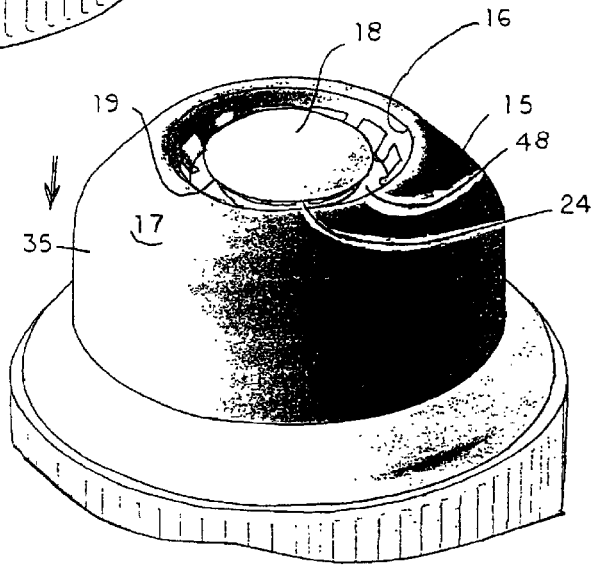
FIG. 2 is a partial top perspective view of the valve closure shown in FIG. 1, depicted with the valve in its open position.

A valve closure 10 in accordance with a preferred embodiment of the present invention is depicted in its closed position in FIG. 1 and its open position in FIG. 2. The valve closure 10 is normally or biased closed and is opened by pushing, normally with the lips, in preparation for drinking. When the lip pressure is removed, the components of the valve closure spring to the closed position. When the valve 10 is closed, it will not leak when the container or bottle to which is it attached is jostled, turned on its side or turned upside down.

The valve closure most preferably utilizes two moldable components, a base component 312 and a cap component 14 that are movable relative to each other. The closure is provided with an elastomeric or flexible seal 40 (FIG. 5) that optimally performs two functions—sealing the closure and acting as a compression or biasing spring.

Figure 3:
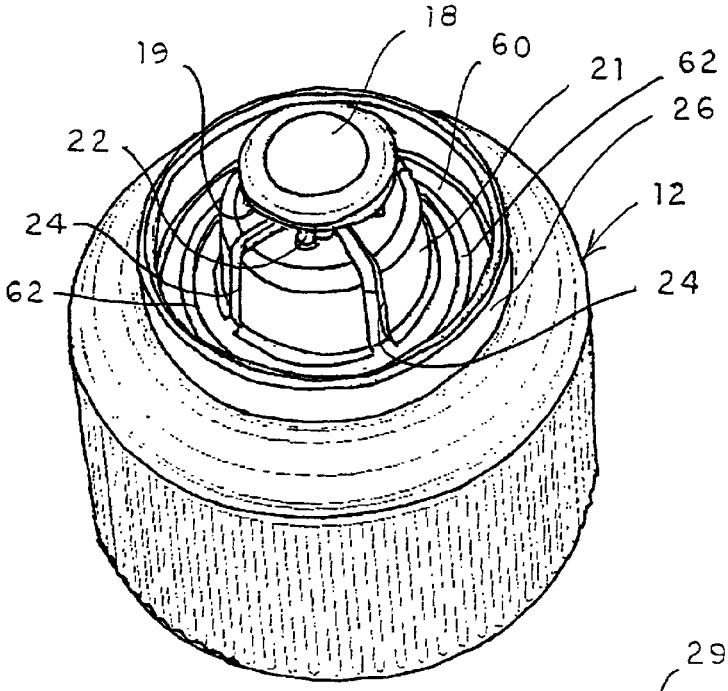
FIG. 3 is a top perspective view of a base component of the valve closure shown in FIGS. 1 and 2.
Figure 4:
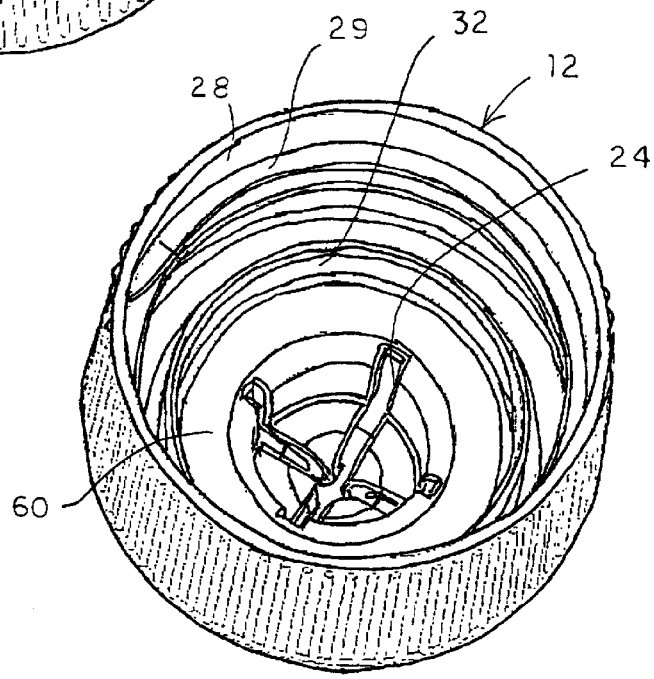
FIG. 4 is a bottom perspective view of the base component shown in FIG. 3.

The first component, the base 12 is preferably a generally rigid piece that is configured to be engaged to the container or bottle. Most preferably, the base 12 is molded of a plastic material, such as polypropylene. As shown in more detail in FIGS. 3 and 4, the base 12 includes a closure portion 20 that is configured to cover the mouth of the container or bottle. The closure portion supports a valve element 18, which is in the form of a generally flat disc. The valve element 18 defines an undercut 19 at the lower surface of the element, which serves as a sealing surface as described in more detail herein.

The valve element 18 is supported on a pedestal 21 that is disposed in the middle of the cylindrically formed base 12 and closure portion 20. The pedestal can include struts 22 to support the valve element above the pedestal. In one feature of the inventive valve closure, the pedestal 21 is fenestrated, meaning that it defines a number of fluid openings 24 therethrough. The openings provide a pathway for liquid within the associated container to flow out of the valve closure when the valve is open.

The upper face of the base 12 further defines a guide cylinder 26 projecting upward from the closure portion 20 and concentric with the pedestal 21 and valve element 18. The guide cylinder 26 provides a sliding sealing surface for the cap 14, as described herein. The lower portion of the base 12 is a cylindrical skirt 28 that is configured for engaging the base over the mouth of a liquid container or bottle. In a preferred embodiment, the skirt 28 carries internal threads 29 that are sized to mate with the threaded mouth of a typical beverage or sports water bottle. Of course, other means for engaging the skirt 28, and ultimately the base 12, to the container/bottle are contemplated, including engagements that are substantially permanent. However, the threaded engagement provided by threads 29 are most preferred for a reusable water bottle to allow the bottle to be refilled. Moreover, the threaded closure is beneficial for consumer beverages that include a tamper film over the mouth of the bottle, to allow removal of the closure to dislodge the film. The base 12 can also include an interior annular engagement flange 32 (FIGS. 4 and 6) that can seal against the inside of the opening of the container or bottle. In certain specific applications, the annular flange 32 can be configured to compromise a tamper seal upon rotation of the base 12.

Figure 5:
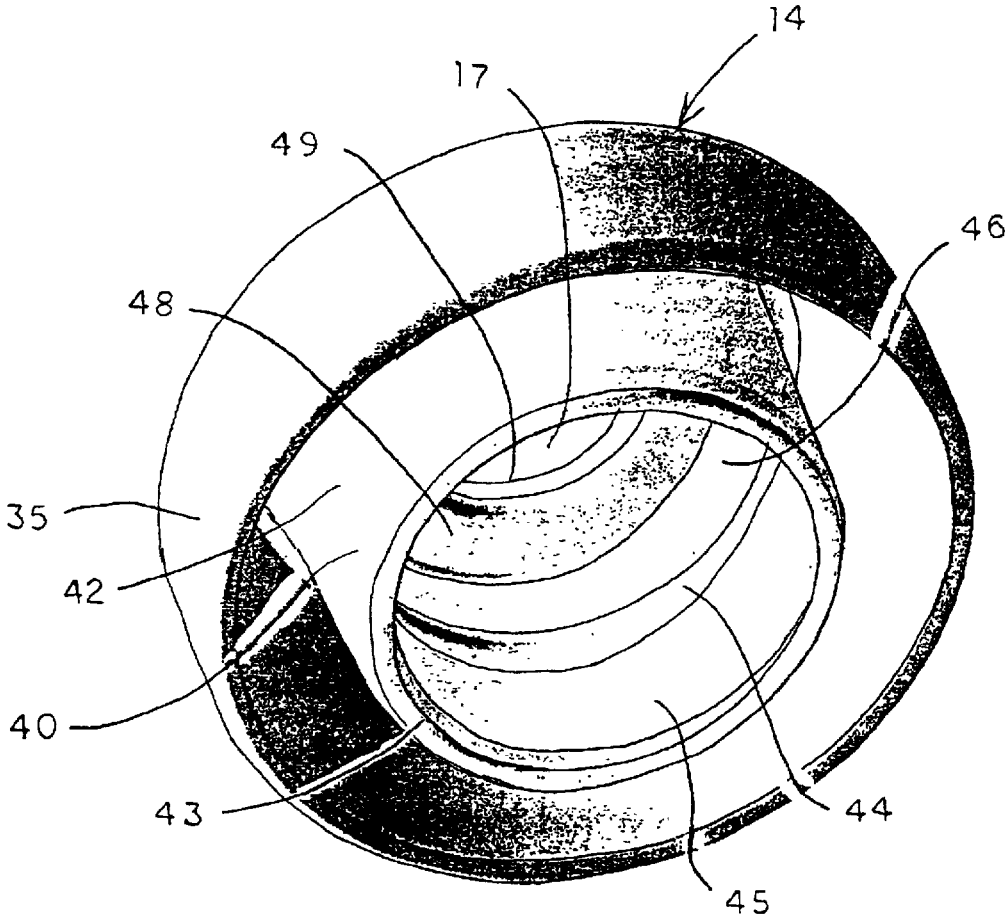
FIG. 5 is a bottom perspective view of a cap component of the valve closure shown in FIGS. 1 and 2.

Referring again to FIGS. 1 and 2, along with reference to FIG. 5, the second component, or cap 14 includes two sub-components—a generally cylindrical body 15 and an elastomeric seal 40 (FIG. 5). The body 15 can be formed of a generally rigid moldable material, and even of the same material as the base 12. The body defines a central drinking opening 16 that is surrounded by a user-friendly drinking surface 17. The drinking surface can be generally frusto-conical in form to provide an ergonomic surface for contacting the lips of the consumer. The surface 17 can be textured or treated to be non-irritating to the consumer, and to allow a generally leak-proof seal when the consumers lips are in contact with the surface.

In the preferred embodiment, the drinking surface 17 and opening 16 surround the valve element 18, and even conceal the element below the surface 17. With this feature, the lips or teeth of the consumer need not touch the valve element 18, even when the cap 14 is depressed as shown in FIG. 2.

The body 15 also includes an outer sealing skirt 35 that is juxtaposed around the guide cylinder 26 (FIG. 6) on the base 12 when the cap 14 is snapped onto the base. The outer skirt 35 slides along the guide cylinder 26 when the cap is depressed relative to the base and acts to stabilize and guide the movement of the cap.

The body 15 is concentrically disposed about the valve element 18 and pedestal 21, as shown in FIGS. 1 and 2. The position of the body, and ultimately the cap, is maintained by the second sub-component, the elastomeric, resiliently deformable or flexible seal 40. The elastomeric seal 40 is most preferably formed of a generally flexible material that exhibits spring-like characteristics when used in accordance with the present invention. The seal 40 can be formed of a somewhat stiff rubber material that will hold the generally cylindrical or cup-like shape of the seal 40 and that will return to that shape when briefly deformed.

Figure 6:
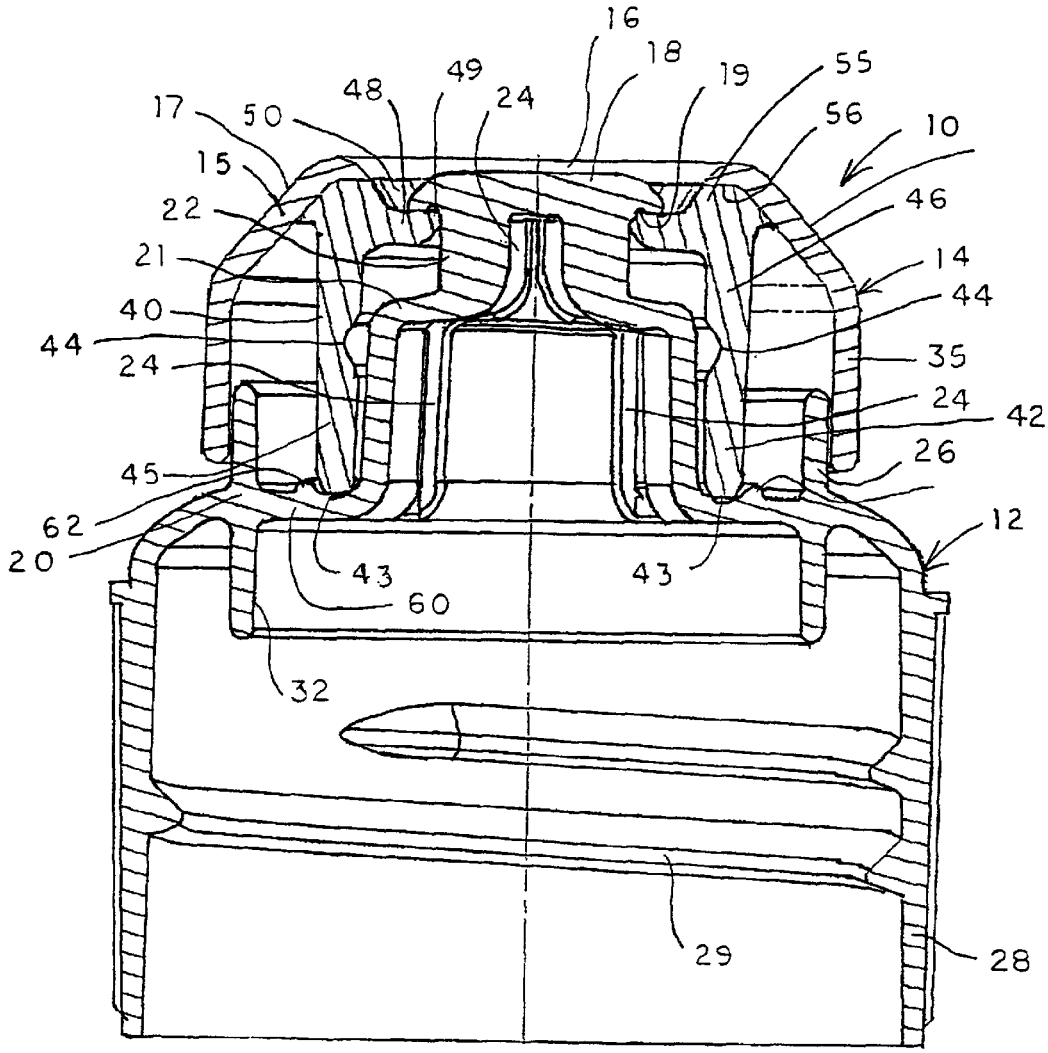
FIG. 6 is a side cross-sectional view of the valve closure shown in FIG. 1 with the valve in its normally closed position.

In accordance with the preferred embodiment, the seal 40 includes a cylindrical element 42 that terminates at its lower end in a lower sealing rim 43. The cylindrical element 42 is divided by a flexible hinge 44 into a lower portion 45 and an upper portion 46. The lower portion 45 ends in the lower sealing rim 43, while the upper portion defines features for engaging the valve element 18. More specifically, the seal 40 includes an annular sealing disc 48 at the top of the upper portion 46. The disc 48 defines an annular sealing rim 49 that is configured to bear against the undercut 19 of the valve element 18, as shown in FIG. 6. In an alternative embodiment, the undercut 19 of the valve element 18 can be configured to follow the contour of the upper sealing rim 49 to further enhance the fluid-tightness of the closure.

The opening defined by the rim 49 has a diameter less than the outer diameter of the valve element 18. The two diameters are preferably sized so that a significant amount of radial overlap exists between the two components. This radial overlap provides substantial sealing area for maintaining a fluid-tight seal when the valve closure is in its normally closed position. Significantly, the radial overlap essentially locks the cap 14 onto the base 12. The flexible nature of the elastomeric seal 40 will allow the sealing disc 48 to temporarily deform as the cap is pressed down onto the valve element 18. Once the disc has passed to the undercut 19, the disc springs back to its original shape to hold the cap in position.

Figure 7:
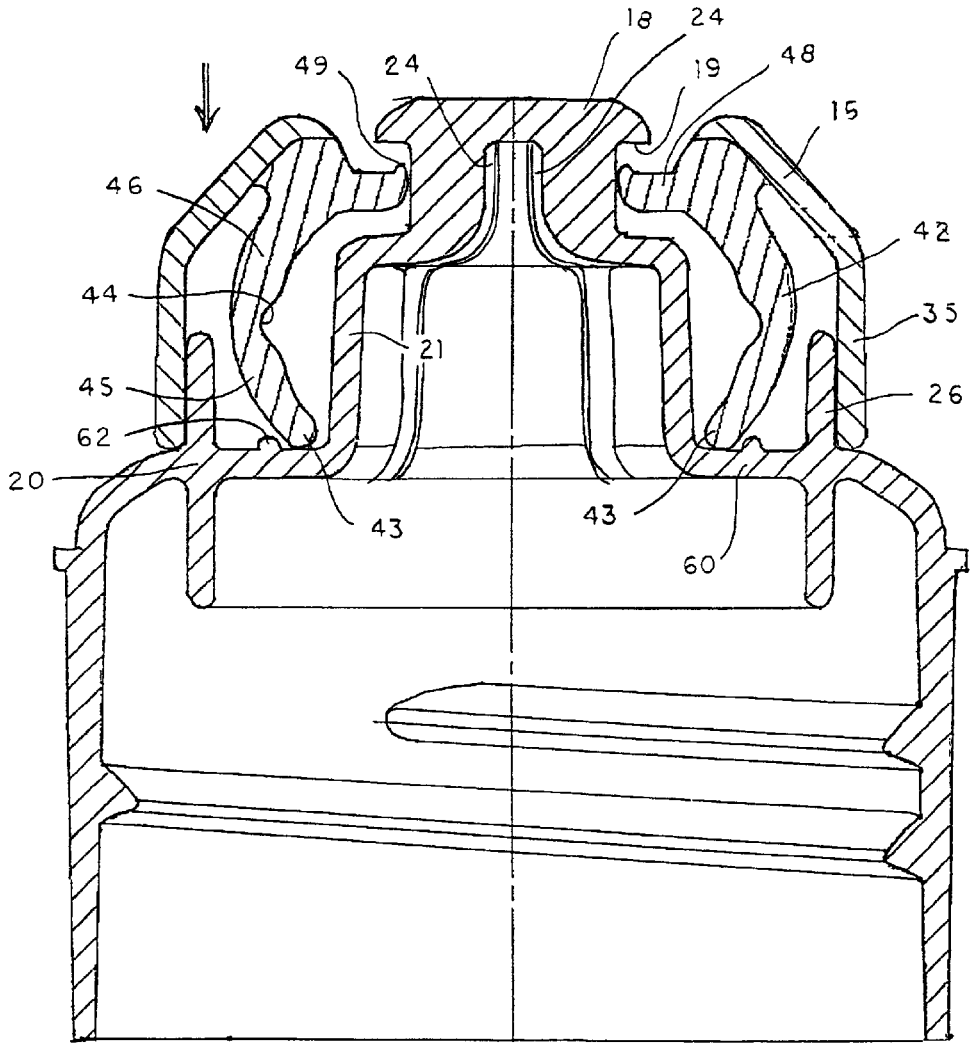
FIG. 7 is a side cross-sectional view of the valve closure shown in FIG. 2 with the valve in its open position.

The opening defined by the upper sealing rim 49 can also be sized relative to the outer diameter of the pedestal 21 supporting the valve element 18. As shown in FIGS. 6 and 7, the rim 49 rides along a cylindrical section of the pedestal 21. In the preferred embodiment, this section includes the support struts 22. In an alternative embodiment, the struts can provides continuous cylindrical surface that is contacted by the sealing rim 49. This contact can provide an additional fluid seal in conjunction with the seal between the disc 48 and valve element 18.

In one specific embodiment, the entirety of the cap 14 can be formed of the same material. Thus, the entire cap can be molded from the resilient or elastomeric material needed to generate the fluid-tight seal and provide the spring-like properties to bias the valve to its closed position.

However, in the preferred embodiment, the two sub-components of the cap 14 are distinct parts that are molded together using a two material molding process. This process can ensure a higher quality, less expensive production as assembly operations are eliminated. In order to facilitate the molding process, the elastomeric seal 40 is provided with a number of fingers 50 projecting upwardly from the sealing disc 48 or the upper portion 46 of the seal 40. The body 15 defines a like number of slots 52 (FIGS. 1 and 6) that interlock with the fingers 50. In a preferred process, the elastomeric seal 40 is formed in one mold and then the finished sub-component is transferred to a second mold. The body 15 is over-molded about the newly molded seal 40 in this second mold with the fingers 50 and slots 52 mated in interlocking fashion.

The proper selection of materials is important to insure function and reliability for this valve closure 10. In the case of molding the cap 14 and seal 40 together in a two material press, both melt and glass transition temperatures are critical, as it is essential that the second material molded does not erode the structure of the first material, while at the same time attaining a cohesive bond.

In a further feature of the preferred embodiment, the upper portion 46 of the elastomeric seal 40 can define a raised sealing bead 55, as seen in FIG. 6. The interior of the body 15 can have a complementary formed recess 56 to receive the bead 55. The two features can be formed in interlocking fashion using the over-molding process just described. In this manner, the elastomeric seal 40 will be firmly attached or connected to the body 15 of the cap 14.

As thus far described, the elastomeric seal 40 includes a feature (the sealing disc 48) for retaining the cap 14 on the base 12. Like the upper sealing rim 49, the lower sealing rim 43 also has a surface against which it seals when the valve is in its normally closed position, and actually in all positions of the valve. More specifically, the base 12 includes an intermediate plate 60 situated at the base of the pedestal 21. The intermediate plate 60 can be situated at the top of the annular flange 32 so that the plate can contact and seal against the mouth of the container or bottle, thereby providing yet another fluid sealing surface.

However, the plate 60 serves an important role in the function of the elastomeric seal. As shown in FIG. 6, the lower sealing rim 43 bears against the intermediate plate 60 so that the elastomeric seal 40 is trapped between the plate 60 at its lower end and the valve element 18 at its upper end. The elastomeric seal 40 is dimensioned so that the lower and upper sealing rims 42 and 49, respectively, are always in sealing contact with their respective sealing surfaces when the valve is in its normally closed position. Thus, the dimension from the intermediate plate 60 and the undercut 19 is slightly less than the dimension between the two sealing rims 42 and 49.

The action of the elastomeric seal 40 can be appreciated upon a comparison of the configurations depicted in FIGS.

6 and 7. The valve closure is shown in its normally closed position in FIG. 6. As a downward force is applied in the direction of the arrow in FIG. 7, the seal 40 buckles or bows outwardly in a sort of bellows movement. This bowing movement is a product of the flexible hinge 44 between the lower and upper portions 45 and 46. In addition, the portions 45 and 46 themselves may bow slightly; however, the bulk of the bellows movement is due to the flexible hinge.

Of course, as the seal 40 deforms, the upper sealing rim 49 translates away from the undercut 19 of the valve element 18. This movement exposes the fluid openings 24 of the fenestrated pedestal 21 so that liquid can flow freely through the drinking opening 17 in the cap 14. As shown in FIGS. 6 and 7, the fluid openings 24 can extend immediately adjacent the undercut 19 so that even a minimal movement of the cap 14 relative to the base 12 will allow liquid to flow. As the cap is pushed farther away from the valve element, more of the fluid openings 24 are exposed, thereby allowing increase flow of liquid from the bottle. Thus, the user can regulate the flow rate of the liquid being consumed.

In alternative embodiments, the fluid openings 24 can end before the undercut so that no fluid flows when the cap is only slightly depressed. This approach may reduce the likelihood of accidental leakage when the cap is lightly contacted. As a further alternative, the primary flow path can contemplate flow between the pedestal and the opening defined by the upper sealing rim 49. In this instance, the inner diameter of the sealing disc opening would be large enough relative to the outer diameter of the pedestal 21 to provide an adequate flow path for the liquid. Flow would start once the sealing rim 49 moved out of contact with the undercut 19.

In accordance with an important feature of the present invention, the elastomeric seal 40 springs back to its original shape when the pressing force is removed from the cap 14. The natural elasticity of the seal material will cause the flexible hinge 44 to return to the position shown in FIG. 6. In order to enhance this spring-back capability, the cylindrical element 42 can be formed slightly conical with the lower sealing rim 43 being slightly inboard. This conical feature will help ensure that the elastomeric seal 40 bows outwardly when depressed and increases the spring-back or elastic restorative force for the seal 40.

As an additional safety measure, the intermediate plate 60 can define an annular retention bead 62 that is outboard of the base of the pedestal. As shown in FIGS. 6 and 7, the retention bead 62 maintains the position of the lower sealing rim 43 as the seal 40 deforms. When the cap 14 is depressed, the retention bead 62 can act as a fulcrum for the outward bowing the lower portion 45 of the cylindrical element 42.

Actuation of this valve is "hands free", since it allows the user to drink from the bottle by placing the upturned container against their lips and applying minimal force. When there is no force against the valve closure, it snaps closed, and no liquid can escape. Spills are not possible, as flow must be intentional.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A closure for a liquid container comprising:

a base component including;

a skirt configured for engagement about the mouth of the liquid container;

a closure portion connected to said skirt and covering the mouth of the container when the skirt is engaged thereon, said closure portion defining a number of openings for the passage of the liquid therethrough; and a valve element supported by said closure portion, said valve element defining an undercut sealing surface; and a cap component including;

a body defining a surface configured for contact by the lips of a consumer drinking the liquid;

a sealing element connected to said body and configured to contact said undercut sealing surface in a substantially leak-proof engagement, whereby flow from said number of openings is controlled by said substantially leak-proof engagement; and a resiliently deformable seal directly connected at one end to said sealing element and disposed about said closure portion of said base component, said seal having a first sealing rim at an end opposite said one end in continuous substantially fluid-tight contact with said closure portion of said base component, whereby said resiliently deformable seal supports said cap member on said base member so that said cap member can be depressed by contact with surface of said body to move said sealing element apart from said valve element to expose said number of openings in said closure portion for liquid flow therefrom.

2. The closure for a liquid container according to claim 1, wherein said resiliently deformable seal includes a flexible hinge between an upper and a lower portion thereof.

3. The closure for a liquid container according to claim 1, wherein:

said closure element includes an annular plate spanning said skirt and a pedestal projecting from said plate, said pedestal supporting said valve element and defining said number of openings; and further wherein said first sealing rim is in continuous substantially fluid-tight engagement with said plate.

4. The closure for a liquid container according to claim 3, wherein:

said plate defines a retention bead concentrically disposed outboard of said pedestal; and said first sealing rim is disposed between said pedestal and said retention bead.

5. The closure for a liquid container according to claim 1, wherein said resiliently deformable seal includes a cylindrical element concentrically disposed about a portion of said closure element.

6. The closure for a liquid container according to claim 5, wherein said substantially cylindrical element tapers inward toward said first sealing rim.

7. The closure for a liquid container according to claim 5, wherein said substantially cylindrical element includes a flexible hinge between an upper and a lower portion thereof.

8. The closure for a liquid container according to claim 1, wherein said sealing element includes an annular disc having an inner diameter smaller than an outer diameter of said valve element.

9. The closure for a liquid container according to claim 8, wherein said sealing element defines an upper sealing rim on said annular disc arranged for sealing engagement with said undercut sealing surface of said valve element.

10. The closure for a liquid container according to claim 1, wherein said body is over-molded about said sealing element.

11. The closure for a liquid container according to claim 1, wherein said sealing element is integrally formed with said resiliently deformable seal.

12. The closure for a liquid container according to claim 1, wherein said base component includes a cylindrical flange projecting downward from said closure portion for sealing contact with the mouth of the container when said skirt is engaged on the container.

13. The closure for a liquid container according to claim 1, wherein:

said base component includes a guide cylinder projecting upward from said closure portion; and said body of said cap component includes a sealing skirt configured to be concentrically disposed about said guide cylinder.

14. The closure for a liquid container according to claim 1, wherein said surface of said body extends above said valve element when said sealing element is in sealing engagement with said undercut sealing surface.

15. A closure for a liquid container comprising:

a base component configured for engagement about the mouth of the liquid container, said base component including;

a valve element defining an undercut sealing surface; and a number of openings in communication with the mouth of the container when said base component is engaged thereon;

a cap body engaged on said base component between said valve element and said number of openings, said cap body including a sealing element disposed around at least a part of the base component, said cap body movable relative to said base component from a closed position in which said sealing element is in sealing contact with said undercut sealing surface, to an open position in which said sealing element is displaced away from said undercut sealing surface to expose at least a portion of said number of openings for fluid flow; and a resiliently deformable seal concentrically disposed about said number of openings between said cap body and said base component, said seal including a flexible hinge to permit deformation of said seal when said cap body is moved from said closed position to said open positions, wherein said can body and said base component cooperate to define a sealing engagement outboard of said resiliently deformable seal.

16. The closure for a liquid container according to claim 15, wherein said seal includes a substantially cylindrical element including said flexible hinge between an upper and a lower portion thereof.

17. The closure for a liquid container according to claim 16, wherein said substantially cylindrical element has tapered walls.

18. A closure for a liquid container comprising:

a base component including;

a skirt configured for engagement about the mouth of the liquid container;

a closure portion connected to said skirt and covering the mouth of the container when the skirt is engaged thereon, said closure portion defining a number of openings for the passage of the liquid therethrough; and a valve element supported by said closure portion, said valve element defining an undercut sealing surface; and a cap component including;

a body defining a surface configured for contact by the lips of a consumer drinking the liquid;

a sealing element connected to said body and surrounding at least a part of said closure portion, said sealing element configured to contact said undercut sealing surface in a substantially leak-proof engagement, whereby flow from said number of openings is controlled by said substantially leak-proof engagement; and a resiliently deformable seal connected at one end to said sealing element and disposed about said closure portion of said base component, said seal having a first sealing rim at an end opposite said one end in continuous substantially fluid-tight contact with said closure portion of said base component, whereby said resiliently deformable seal supports said cap member on said base member so that said cap member can be depressed by contact with surface of said body to move said sealing element apart from said valve element to expose said number of openings in said closure portion for liquid flow therefrom.

* * * * *